US010064526B2

(12) United States Patent
Nonaka

(10) Patent No.: US 10,064,526 B2
(45) **Date of Patent: *Sep. 4, 2018**

(54) TOILET SEAT SHEET

(71) Applicant: Akiyoshi Nonaka, Oita (JP)

(72) Inventor: Akiyoshi Nonaka, Oita (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/503,248

(22) PCT Filed: Dec. 8, 2014

(86) PCT No.: PCT/JP2014/082422

§ 371 (c)(1),
(2) Date: Feb. 10, 2017

(87) PCT Pub. No.: WO2016/046999

PCT Pub. Date: Mar. 31, 2016

(65) Prior Publication Data

US 2017/0231441 A1 Aug. 17, 2017

(30) Foreign Application Priority Data

Sep. 24, 2014 (JP) ..... 2014-193519

(51) Int. Cl.
*A47K 13/16* (2006.01)

(52) U.S. Cl.
CPC ..... *A47K 13/16* (2013.01)

(58) Field of Classification Search
CPC ..... A47K 13/16
See application file for complete search history.

(56) References Cited

U.S. PATENT DOCUMENTS 1,744,300 A * 1/1930 Dewaide ..... A47K 13/16 4/245.9
1,776,333 A * 9/1930 Oates ..... A47K 13/16 4/244.2

(Continued)

FOREIGN PATENT DOCUMENTS

FR 319032 A 2/1902
JP 2000-175842 A 6/2000

OTHER PUBLICATIONS

International Search Report dated Feb. 10, 2015 issued in corresponding PCT/JP2014/082422, 2 pages.

(Continued)

*Primary Examiner* — J. Casimer Jacyna
(74) *Attorney, Agent, or Firm* — Millen, White, Zelano & Branigan, P.C.; William Nixon

(57) ABSTRACT

The toilet seat sheet includes a sheet body, an opening formed at a central section of the sheet body, and a separation portion configured to be separated from an inner edge of the opening. The separation portion includes a breaking connection that connects the separation portion to the sheet body, the breaking connection being arranged on a right obliquely rear side and/or a left obliquely rear side of the inner edge of the opening. Further, a rear side edge of the separation portion 3 includes a right side outwardly curved section 321 that protrudes right obliquely rearward and a left side outwardly curved section 322 that protrudes left obliquely rearward. The right side outwardly curved section 321 and the left side outwardly curved section 322 are arranged side by side.

8 Claims, 8 Drawing Sheets

(56) References Cited

U.S. PATENT DOCUMENTS

| | | | | |
|---|---|---|---|---|
| 4,875,242 | A * | 10/1989 | Albrecht | A47K 13/16 4/245.4 |
| 4,887,321 | A * | 12/1989 | MacLean | A47K 13/18 4/244.2 |
| 7,254,845 | B1 | 8/2007 | Morad | |
| 7,328,465 | B1 | 2/2008 | Morad | |
| 2002/0184701 | A1* | 12/2002 | Johnson | A47K 13/16 4/245.5 |
| 2014/0215701 | A1* | 8/2014 | Jenkins | A47K 13/16 4/245.1 |
| 2017/0188761 | A1* | 7/2017 | Nonaka | A47K 13/16 |

OTHER PUBLICATIONS

Specification and Drawings of Japanese Utitlity Model Application No. 62-132237, 15 pages.
English translation Abstract of JP2000-175842A1 published Jun. 27, 2000 (2 pages).

* cited by examiner

TOILET SEAT SHEET

TECHNICAL FIELD

The present invention relates to a toilet seat sheet to be used by being placed on a toilet seat of a Western style toilet.

BACKGROUND TECHNIQUE

When using a Western style toilet installed in a public lavatory, it is required that a toilet seat which comes into direct contact with a user's skin be maintained cleanly and hygienically.

However, in a Western style toilet installed in a public lavatory, it is extremely rare that a toilet seat has a special measure to keep the toilet seat clean and sanitary. Therefore, for the purpose of preventing a direct contact of a user's skin with the toilet seat, it is common for a user to use a toilet seat by placing a toilet seat sheet made of a paper, etc., on the toilet seat.

Under the circumstances, as described in Patent Document 1, a toilet seat sheet is proposed. The toilet seat sheet is provided with an opening or a cutting line for forming an opening at a center section of a sheet material. The toilet seat sheet is characterized in that the sheet material is folded along a line segment extending in a predetermined direction in a band shape so that the center section of the sheet material, which includes the opening or the cutting line, and the outside sections of the sheet material on both sides of the center portion, which do not include the opening sections or the cutting line, are overlapped.

This toilet seat sheet is provided with a separation portion surrounded by a horseshoe-shaped cutting line in the center of the sheet. The separation portion is configured to hang down from the sheet body to adhere to the front or rear inner side surface of the toilet bowl. After defecation, the separation portion is pulled into the flow of flushing water. As a result, the separation portion pulls down the sheet body, resulting in an automatic discharge of the toilet seat sheet from the toilet seat.

PRIOR ART

Patent Document

Patent Document 1: Japanese Unexamined Patent application Publication No. 2000-139774

SUMMARY OF THE INVENTION

Problems to be Solved by the Invention

The toilet seat sheet is removed from a packaging bag, and the separation portion is separated from the sheet body by hand along the cutting line so that the separation portion hangs down from the inner edge of the sheet body. In this state, the toilet seat sheet is placed on a toilet seat.

For this reason, when separating the separation portion from the sheet body, it was required to repeat the operation of pulling both sides of the cutting line by hand while gradually changing the pulling position. Therefore, the separation operation of the toilet seat sheet was troublesome.

Further, when there is a hanging connection for hanging the separation portion from the sheet body, since the separation portion hangs down from the toilet seat sheet at the time of placing the toilet seat sheet, an operation of placing the toilet seat sheet should be performed so that the separation portion adheres to a predetermined section of the inner surface of the toilet bowl in a state in which the separation portion swings due to air resistance, etc. Thus, the placing of the toilet seat sheet was troublesome.

Further, if the separation portion adheres to an unexpected section of the inner surface of the toilet bowl, there is a possibility that the sheet body is pulled by the separation portion after placing, causing a deviation of the sheet body from an appropriate position.

There also is a concern that a user unintentionally cuts off the hanging connection when separating the separation portion along the cutting line.

The present invention was made in view of the aforementioned problems, and aims to provide a toilet seat sheet capable of automatically separating a separation portion from a sheet body.

Means for Solving the Problems

To attain the aforementioned purpose, the present invention has following features. A toilet seat sheet is provided with a sheet body, an opening formed in a central section of the sheet body, and a separation portion configured to be separated from an inner edge of the opening. The separation portion is provided with a breaking connection that connects the separation portion to the sheet body, the breaking connection being arranged on a right obliquely rear side and/or a left obliquely rear side of the opening. Further, a rear side edge of the separation portion includes aright side outwardly curved section that protrudes right obliquely rearward and a left side outwardly curved section that protrudes left obliquely rearward, the right side outwardly curved section and the left side outwardly curved section being arranged side by side.

According to this, when the toilet seat sheet is placed on the toilet seat in a state in which the separation portion is not separated and then the rear section of the sheet body receives a pressure from buttocks of a user sitting on the toilet seat, the breaking connection is cut off from the inner edge of the opening. This enables an automatic separation of the separation portion from the sheet body.

It is preferable that the separation portion be formed in a heart shape in a plan view. According to this, a user can easily grasp the front and back sides of the toilet seat sheet from the heart shape, and the design effects by the heart shape can be exerted.

Further, the breaking connection is preferably positioned within a range of 90 degrees to 180 degrees from a foremost end of the separation portion centering on a gravity center position of the separation portion. With this configuration, since the breaking connection is positioned at the position on which a large pressure of buttocks exerts, the breaking connection can be easily cut off from the inner edge of the opening.

Further, the breaking connection preferably has a length within a range of 1 mm to 5 mm. With this, since the breaking connection is formed to have a length of 1 mm or more, it is possible to assuredly perform a temporary connection of the separation portion to the sheet body. Further, since the breaking connection is formed to have a length of 5 mm or less, the breaking connection is easily cut off from the inner edge of the opening.

Further, it is preferable that the separation portion be provided with a hanging connection at an inner edge of the opening, and be configured to hang down via the hanging connection when the breaking connection is cut off from the inner edge of the opening. With this, since the separation portion assuredly adheres to the inner surface of the toilet bowl, the separation portion is pulled by the flow of flushing water after defecation. This pulled separation portion causes pulling of the sheet body via the hanging connection, which enables automatic discharging of the toilet seat sheet from the toilet seat.

The hanging connection is preferably provided at the inner edge on a right obliquely front side or a left obliquely front side of the opening. In this case, since the separation portion is placed right obliquely forward or left obliquely forward of the opening, user's discomforts, such as, e.g., the separation portion to which the user's urine is adhered comes into the user's view, or when the user is a man, the separation portion comes into contact with a part of the user's body, etc., can be alleviated.

Effects of the Invention

According to the present invention, when the toilet seat sheet is placed on the toilet seat in a state in which the separation portion is not separated and then the rear section of the sheet body receives a pressure from buttocks of a user sitting on the toilet seat, the breaking connection is cut off from the inner edge of the opening. This enables an automatic separation of the separation portion from the sheet body.

Thus, the user can automatically separate the separation portion from the sheet body without repeatedly performing an operation of pulling both sides of the cutting line with hand while gradually changing the pulling position. This eliminates the need for performing the separation operation of the toilet seat sheet, which is convenient.

Further, even when there is a hanging connection for hanging the separation portion from the sheet body, since the separation portion will not hang down from the toilet seat sheet when placing the toilet seat sheet, it is merely required to place the toilet seat sheet without placing the toilet seat sheet so that the separation portion adheres to a predetermined section of the inner surface of the toilet bowl. This makes a placing operation of a toilet seat sheet easy.

Further, since there is no concern that the separation portion adheres to an unexpected section of the inner surface of the toilet bowl, it is possible to prevent the sheet body from deviating from its proper position by being pulled by the separation portion after placing.

Also, since a user is not required to manually separate the separation portion from the sheet body along a cutting line, it is possible to prevent the hanging connection from being inadvertently cut off.

Furthermore, the rear side edge of the opening is formed so that aright side outwardly curved section that protrudes right obliquely rearward and a left side outwardly curved section that protrudes left obliquely rearward are arranged side by side. Therefore, the following effects can be obtained. First, when the toilet seat sheet is placed on the toilet seat, the breaking connections provided on the right obliquely rear side and the left obliquely rear side of the inner edge are positioned at the outer side sections of the toilet seat (the sections apart rearward from the opening of the toilet seat). Therefore, when buttocks of a user deforms so as to shift rearward by receiving a pressure from the toilet seat, the breaking connections receive pressure rearward from the buttocks deformed so as to shift rearward, resulting in assured cutting off of the breaking connections.

Secondly, the user can bring up the image of buttocks from the shape of the rear side edge including the right side outwardly curved section that protrudes right obliquely rearward and the left side outwardly curved section that protrudes left obliquely rearward, the right side outwardly curved section and the left side outwardly curved section being arranged side by side. Thus, the user can intuitively grasp the front and rear sides of the toilet seat sheet, enabling an immediate placement of the toilet seat sheet on the toilet seat without referring to the instruction manual.

EMBODIMENT FOR CARRYING OUT THE INVENTION

Next, an embodiment of a toilet seat sheet S according to the present invention will be described with reference to FIGS. 1 to 8. In the present invention, in a state in which a user stands in front of the toilet seat T, the front side of the toilet seat T (lower side in FIG. 1) is referred to as "front side", the rear side of the toilet seat T (upper side of FIG. 1) is referred to as "rear side", the right side of the toilet seat T (right side of FIG. 1) is referred to as "right side", and the left side of the toilet seat T (left side in FIG. 1) is referred to as "left side". In this specification, the term "user" means a person having buttocks D of a size capable of sitting on a general Western style toilet seat T for defecation, specifically a person who has buttocks D having a width of about 240 mm or more.

Figure 1:
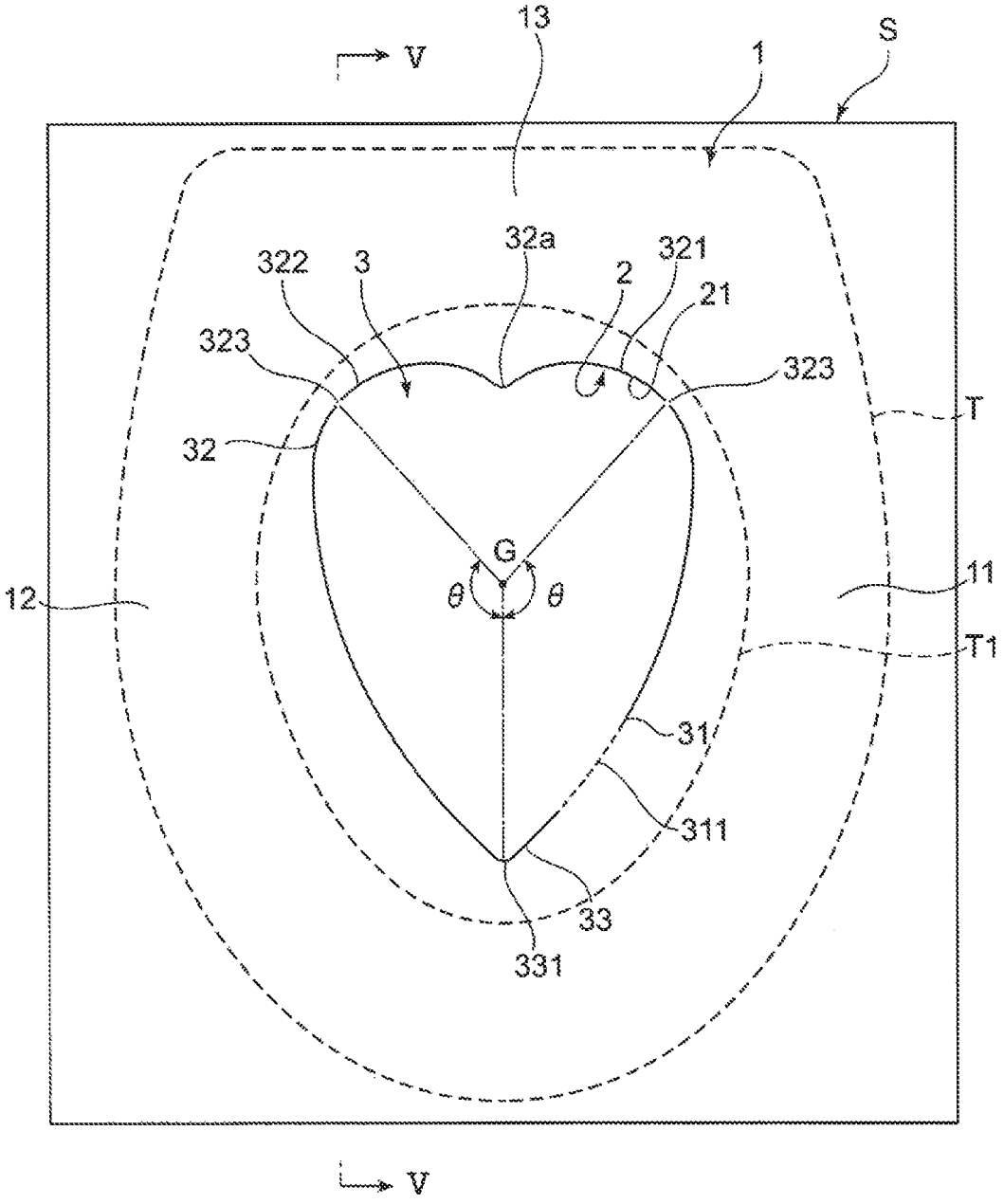
FIG. 1 is a plan view of a toilet seat sheet according to the present invention.

This toilet seat sheet S is used when a user defecates in a Western style lavatory, and is used by being placed on a toilet seat to prevent the direct touching of the user's skin to the toilet seat. This toilet seat sheet S is made of s rectangular thin nonwoven fabric or paper, and is provided with, as shown in FIG. 1, a sheet body 1, an opening 2 formed at the central section of the sheet body 1, and a separation portion 3 configured to hang down from the inner edge 21 of the opening 2.

This sheet body 1 is a portion to be placed on the toilet seat T and is formed to have a size capable of covering the entire toilet seat T. Specifically, the sheet body 1 is formed to have a longitudinal length of 435 mm and a lateral length of 400 mm.

The opening 2 is a defecation hole through which slops are discharged, and is formed so as to cover the periphery of the opening T1 of the toilet seat T. Specifically, it is formed such that a longitudinal length passing the gravity center position G is 203 mm, the lateral length passing the gravity center position G is 165 mm, and the maximum lateral length is 205 mm.

The separation portion 3 is formed in the same size and shape as the opening 2 by being cut out off from the sheet body 1. Therefore, the separation portion 3 and the sheet body 1 can be integrally formed, making it easier to create the toilet seat sheet S, which in turn can reduce the production cost. In the following description, the peripheral edge of the separation portion 3 on the front side of the gravity center position G of the separation portion 3 is referred to as a front side edge 31, and the peripheral edge of the separation portion 3 on the rear side of the gravity center position G is referred to as a rear side edge 32.

As shown in FIG. 1, the separation portion 3 includes a hanging connection 311 at the front side edge 31 on the right obliquely front side. The hanging connection 311 is connected to the inner edge 21 of the opening 2 on the right obliquely front side. The separation portion 3 is formed to have a length capable of coming into contact with the front inner surface I of the toilet bowl when the sheet body 1 is placed on the toilet seat T. Therefore, when the sheet body 1 is placed on the toilet seat T, the separation portion 3 hangs down from the hanging connection 311 as a basal end and adheres to the front inner surface I of the toilet bowl.

Figure 2:
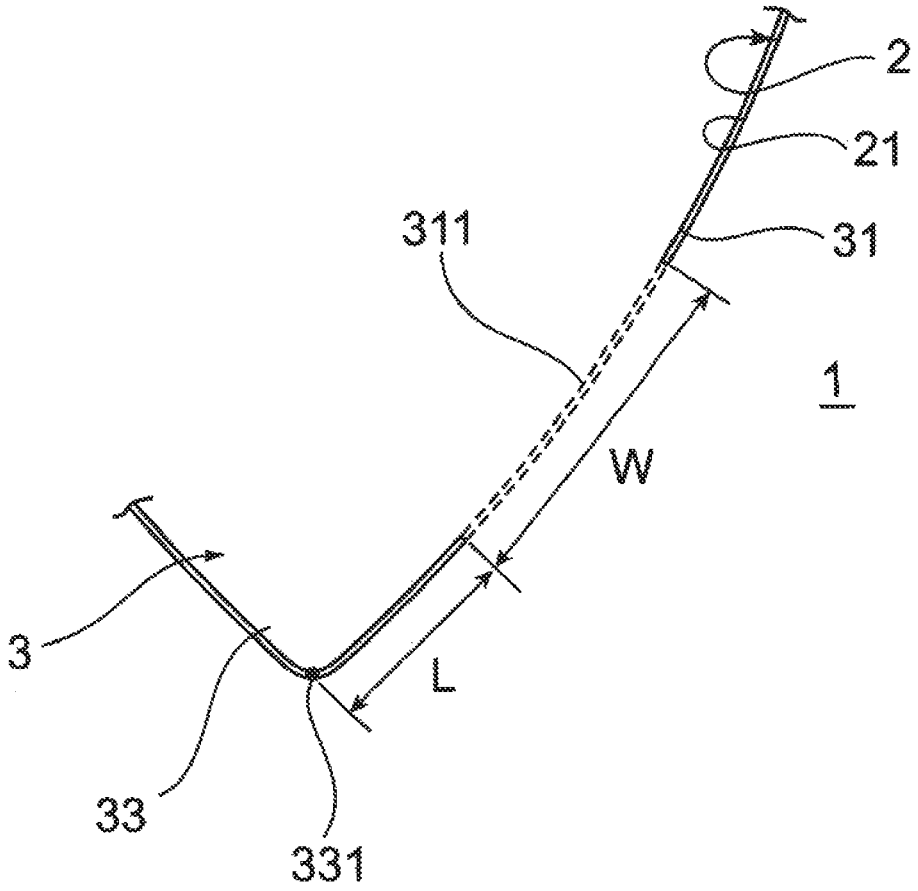
FIG. 2 is an enlarged plan view showing a hanging connection of the toilet seat sheet of FIG. 1.

In this embodiment, as shown in FIG. 2, the hanging connection 311 is formed such that its front end is positioned rearward from the foremost end 331 of the inner edge 21 of the opening 2 within a range of 1 cm to 15 cm (L). This enables more assured adhesion of the separation portion 3 to the front inner surface I of the toilet bowl.

Further, as shown in FIG. 2, the hanging connection 311 is formed to have a length within a range of 1 cm to 10 cm (W). Therefore, by setting the length of the hanging connection 311 to 1 cm or more, it is possible to prevent the hanging connection 311 from being cut off when pulled into the flow of washing water. Further, by setting the length of the hanging connection 311 to 10 cm or less, the hanging connection 311 becomes easy to bend, which enables more assured adhesion of the separation portion 3 to the front side inner surface I of the toilet bowl.

The hanging connection 311 is provided with perforations of about 1 mm along the longitudinal direction at intervals of about 3 mm. With this, the hanging connection 311 becomes easy to bend, which enables more assured adhesion of the separation portion 3 to the front side inner surface I of the toilet bowl.

Figure 3:
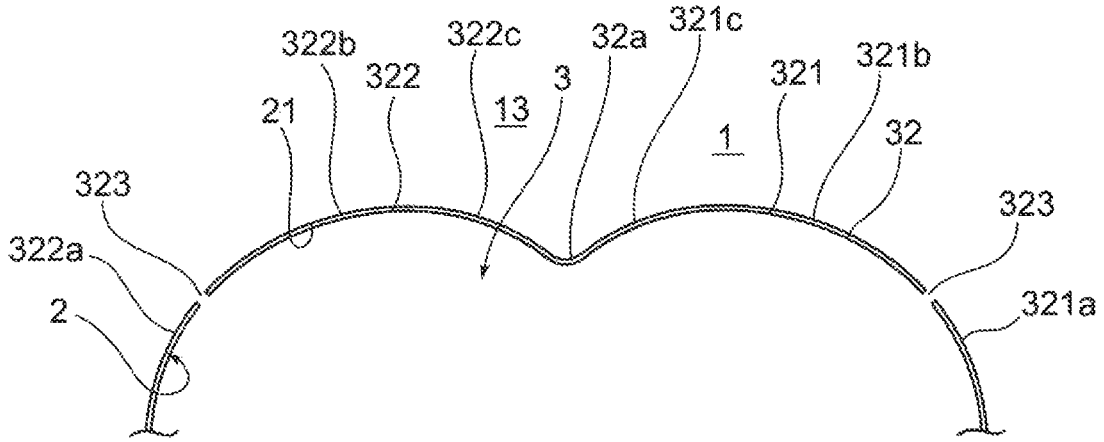
FIG. 3 is an enlarged plan view showing a breaking connection of the toilet seat sheet of FIG. 1.

Further, as shown in FIG. 3, the separation portion 3 is formed into a shape in which the rear side edge 32 imitates rear side buttocks D of a user. Concretely, the rear side edge 32 is formed so that a right side outwardly curved section 321 that protrudes right obliquely rearward and a left side outwardly curved section 322 that protrudes left obliquely rearward are arranged side by side. More specifically, as shown in FIG. 3, the right side outwardly curved section 321 includes a first extension section 321*a* extending rearward while gently curving leftward from the right side rear end of the front side edge 31, a second extension section 321*b* extending leftward while gently curving leftward from the tip of the first extension section 321*a*, and a third extension section 321*c* extending obliquely left forward while curving gently forward from the tip of the second extension section 321*b*. Further, the left side outwardly curved section 322 is formed to be symmetrical to the right side outwardly curved section 321, and includes a first extension section 322*a* extending rearward while gently curving rightward from the left side rear end of the front side edge 31, a second extension section 322*b* extending rightward while gently curving rightward from the tip of the first extension section 321*a*, and a third extension section 322*c* extending forward obliquely rightward while gently curving forward from the tip of the second extension section 322*b*. The right side outwardly curved section 321 and the left side outwardly curved section 322 are connected to each other at the center of the rear side edge 32 by a left-right connecting portion 32*a* formed in a gentle curved shape.

The separation portion 3 is also provided with a breaking connection 323 on the right obliquely rear side of the rear side edge 32 and a breaking connection 323 on the left obliquely rear side of the rear side edge 32. Each breaking connection 323 is formed to have a length of about 1 mm to 5 mm, preferably about 1 mm to 3 mm, more preferably about 1 mm to 2 mm. The breaking connection 323 on the right obliquely rear side is positioned at the inner edge 21 on the right obliquely rear side of the opening 2, and the breaking connection 323 on the left obliquely rear side is positioned at the inner edge 21 of the left obliquely rear side of the opening 2.

According to this, when the toilet seat sheet S is placed on the toilet seat T in a state in which the separation portion 3 is not separated and then the rear section 13 of the sheet body 1 receives a rearward pressure from buttocks of a user sitting on the toilet seat T, the breaking connections 323 are cut off and detached from the inner edge 21 of the opening 2. This enables an automatic separation of the separation portion 3 from the sheet body 1. Moreover, since the rear side edge 32 of the separation portion 3 is formed in a shape along buttocks D of a user when sitting on the toilet seat T, the rear section 13 of the sheet body 1 can more assuredly receive a backward pressure from the buttocks D of the user sitting on the toilet seat T.

Further, in this embodiment, as shown in FIG. 1, the breaking connections 323 of the separation portion 3 are positioned each within a range of 90 degrees to 180 degrees in the angle θ from the foremost end 331 of the separation portion 3 centering on the gravity center position G of the separation portion 3. Preferably, the breaking connection 323 is preferably positioned at the angle θ falling within a range of 100 degrees to 180 degrees, more preferably 130 degrees to 140 degrees. With this configuration, since the breaking connection 323 is positioned at the position where the pressure of buttocks is large, the breaking connection 323 can be easily separated from the inner edge 21 of the opening 2.

Further, since the breaking connection 323 is formed to have a length of 1 mm or more, the separation portion 3 can be assuredly temporarily connected to the sheet body 1. Further, since the breaking connection 323 is formed to have a length of 5 mm or less, preferably 3 mm or less, more preferably 2 mm or less, the breaking connection 323 is more easily cut off from the inner edge 21 of the opening 2.

Further, the breaking connection 323 may include perforations in the longitudinal direction. In this case, the breaking connection 323 is more likely to be cut off from the inner edge 21 of the opening 2.

Further, the separation portion 3 is formed such that the front end portion 33 forms an acute angle. With this, since the front side of the separation portion 3 becomes light in weight and the gravity center position G of the separation portion 3 is shifted rearward, the separation portion 3 easily hangs down from the hanging connection 311. In particular, in this embodiment, the separation portion 3 includes the front side edge 31 and the rear side edge 32 each having the shape as described above, forming a heart shape as viewed from the top. For this reason, a user can easily grasp the front and back sides of the toilet seat sheet S from the heart shape as viewed from the top, and the design effects by the heat shape are exerted.

Hereinafter, the method of using the toilet seat sheet S will be described.

First, a manufacturer folds the toilet seat sheet S, and packages one or more of the folded toilet seat sheets in a packaging bag.

Figure 4:
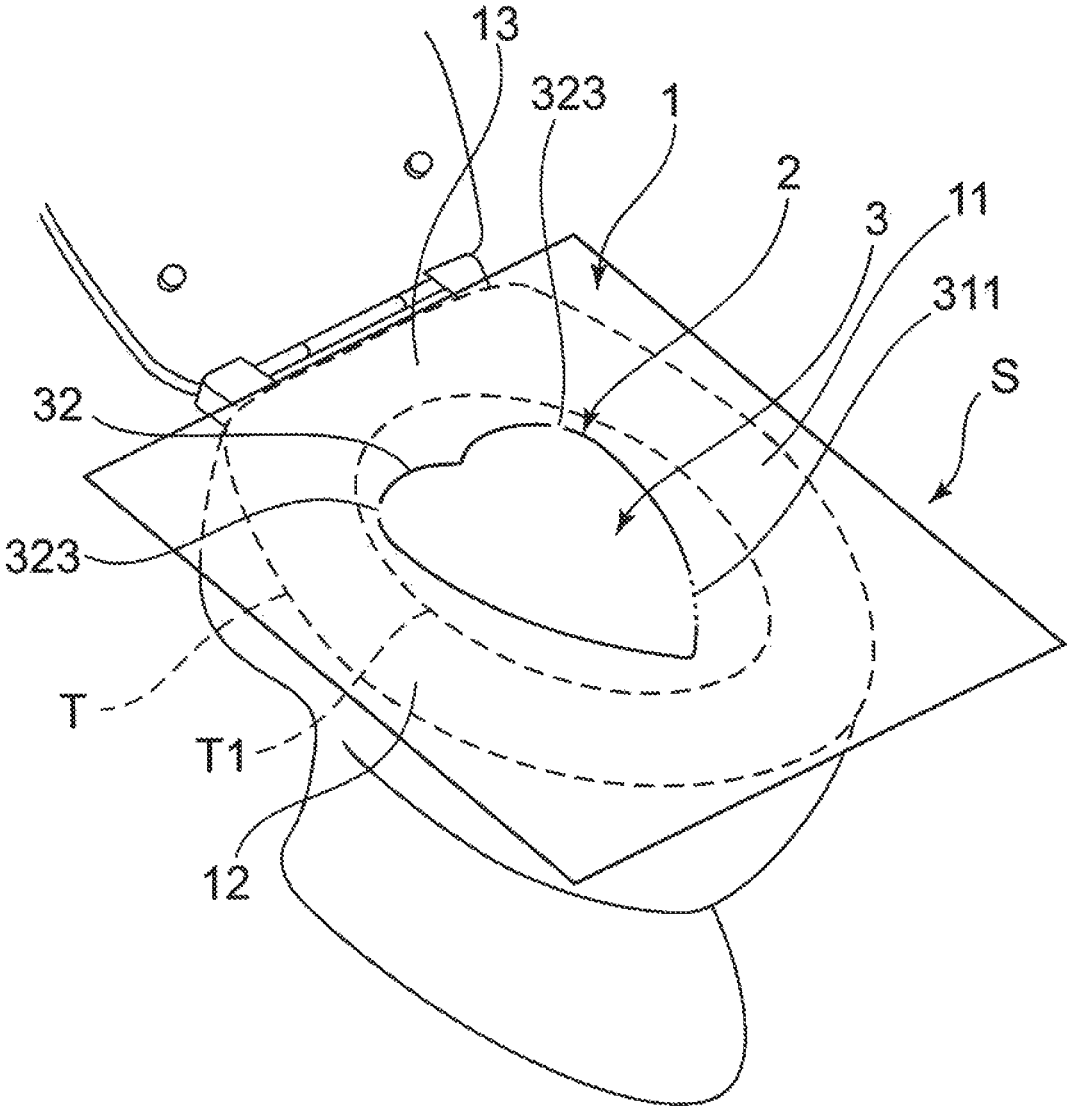
FIG. 4 is a perspective view showing a usage state of the toilet seat sheet of FIG. 1.

Next, as shown in FIG. 4, in a Western style lavatory, a user who purchased the packaged toilet seat sheet S takes out the toilet seat sheet S from the packaging bag and spreads it. Then, the user places the spread toilet seat sheet on the toilet seat T so as to cover the toilet seat T. At this time, in a state in which the front side of the toilet seat sheet S (the side formed to have the acute angle of the heart shape in a plan view) is set on the front side of the toilet seat T and the rear side of the toilet seat sheet S (the side on which the two crest portions 321 and 322 formed in a heart shape are formed) is set on the rear side of the toilet seat T, the user adjusts the position of the toilet seat sheet S in the plane direction so that the inner edge 21 of the opening 2 of the toilet seat sheet S is arranged inside the opening T1 of the toilet seat T. In particular, in this embodiment, since the toilet seat sheet S is formed in a heart shape in a plan view, the front and back sides of the toilet seat sheet S can be easily grasped, which is convenient for a user. In this state, the breaking connections 323 of the separation portion 3 are in a state in which they are connected to the sheet body 1, and the separation portion 3 has not hung down yet.

Therefore, even in cases where there exists a hanging connection 311 for hanging the separation portion 3 from the sheet body 1 as described in this embodiment, the separation portion 3 does not hang down from the toilet seat sheet S at the time of placing the toilet seat sheet S. For this reason, it is only necessary to place the toilet seat sheet S on the toilet seat T without separating the separation portion 3 in advance and without placing so that the separation portion 3 adheres to a predetermined section of the toilet inner surface I, which facilitates placing of the toilet seat sheet S.

Further, the separation portion 3 will not adhere to an unexpected section of the inner surface I of the toilet bowl, which prevents possible displacement of the sheet body 1 from a proper position by being pulled by the separation portion 3 after placing.

Figure 5A:
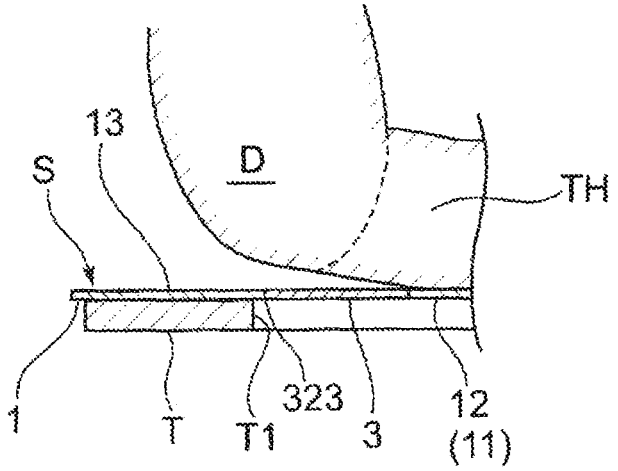
FIG. 5A is an enlarged vertical cross-sectional view taken along the line V-V in FIG. 1 and showing a state immediately before the user sits on the toilet seat.

Next, a user lowers his/her clothes and sits on the toilet seat T on which the toilet seat sheet S is placed. At this time, when buttocks D are lowered toward the toilet seat T, as shown in FIG. 5A, the right central section 11 of the sheet body 1 is clamped between the thigh TH of the left leg of the user and the toilet seat T and fixed on the toilet seat T, and the left central section 12 of the sheet body 1 is clamped between the thigh TH of the right leg of the user and the toilet seat T and fixed on the toilet seat T.

Figure 5B:
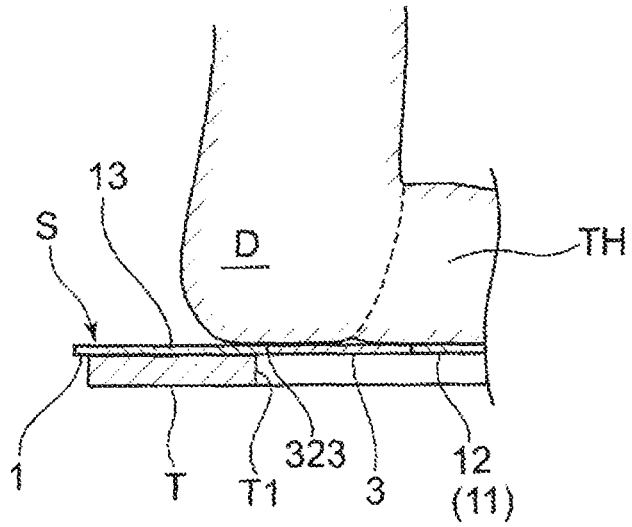
FIG. 5B is an enlarged vertical cross-sectional view showing a state in which the user is about to sit on the toilet seat.

Then, as shown in FIG. 5B, when the buttocks D is further lowered, the rear side edge 32 of the separation portion 3 is covered by the user's buttocks D from above.

Figure 5C:
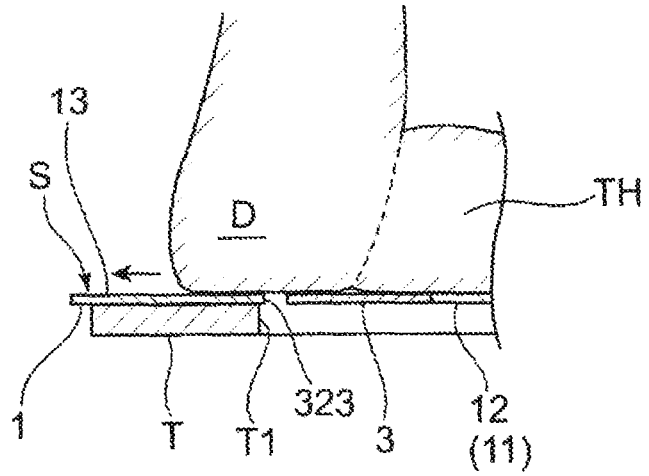
FIG. 5C is an enlarged vertical cross-sectional view showing a state immediately after the user sat on the toilet seat.

When the buttocks D is further lowered, as shown in FIG. 5C, in a state in which the right central section 11 and the left central section 12 of the sheet body 1 are clamped between the thighs TH of the user's left and right legs and the toilet seat T and fixed on the toilet seat T, the rear section 13 of the sheet body 1 receives a pressure in the rearward direction (the direction of the arrow in FIG. 5C) while being pinched between the buttocks D of the user and the toilet seat T. As a result, the breaking connections 323 are cut off so as to be torn off from the inner edge 21 of the opening 2, resulting in an automatic separation of the separation portion 3 from the sheet body 1.

Therefore, the separation portion 3 can be automatically separated from the sheet body 1 without requiring the user's operation of repeatedly pulling both sides of the cutting line while gradually shifting the pulling position, which eliminates the operation of separating the separation portion 3 of the toilet seat sheet S, which is convenient.

Further, since it is not required for the user to manually detach the separation portion 3 from the sheet body 1 along the cutting line, an inadvertent separation of the hanging connection 311 can be prevented.

Figure 6:
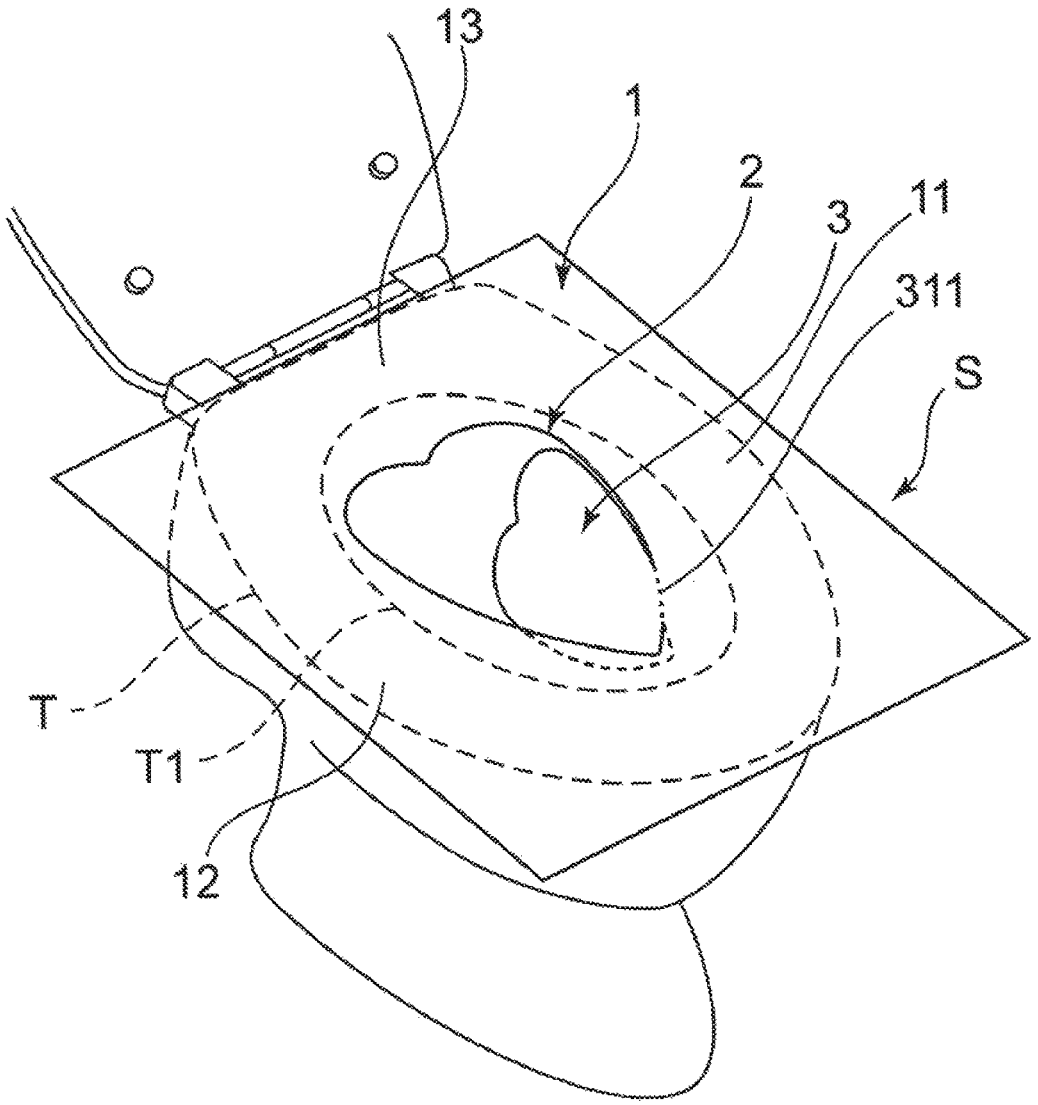
FIG. 6 is a perspective view showing a usage state of the toilet seat sheet of FIG. 1.
Figure 7:
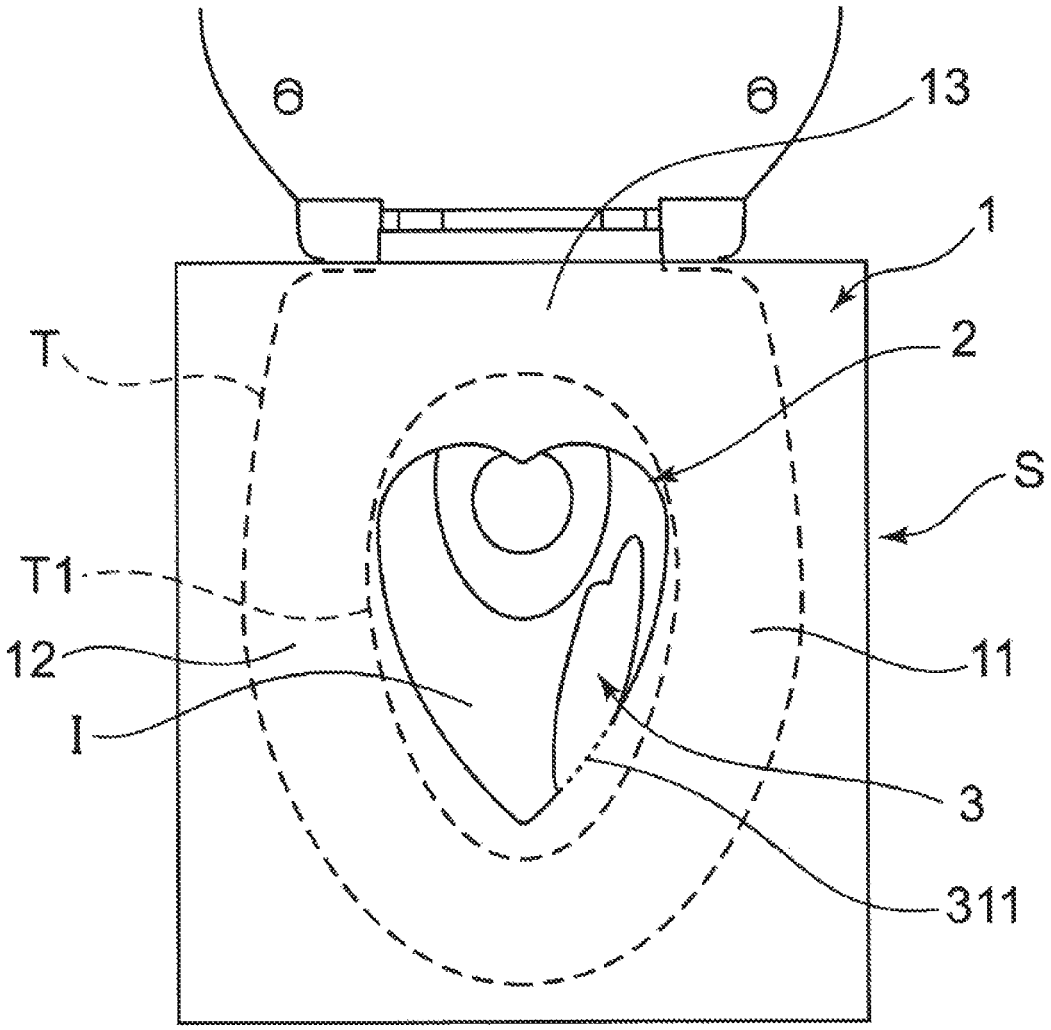
FIG. 7 is a plan view showing a usage state of the toilet seat sheet of FIG. 1.
Figure 8:
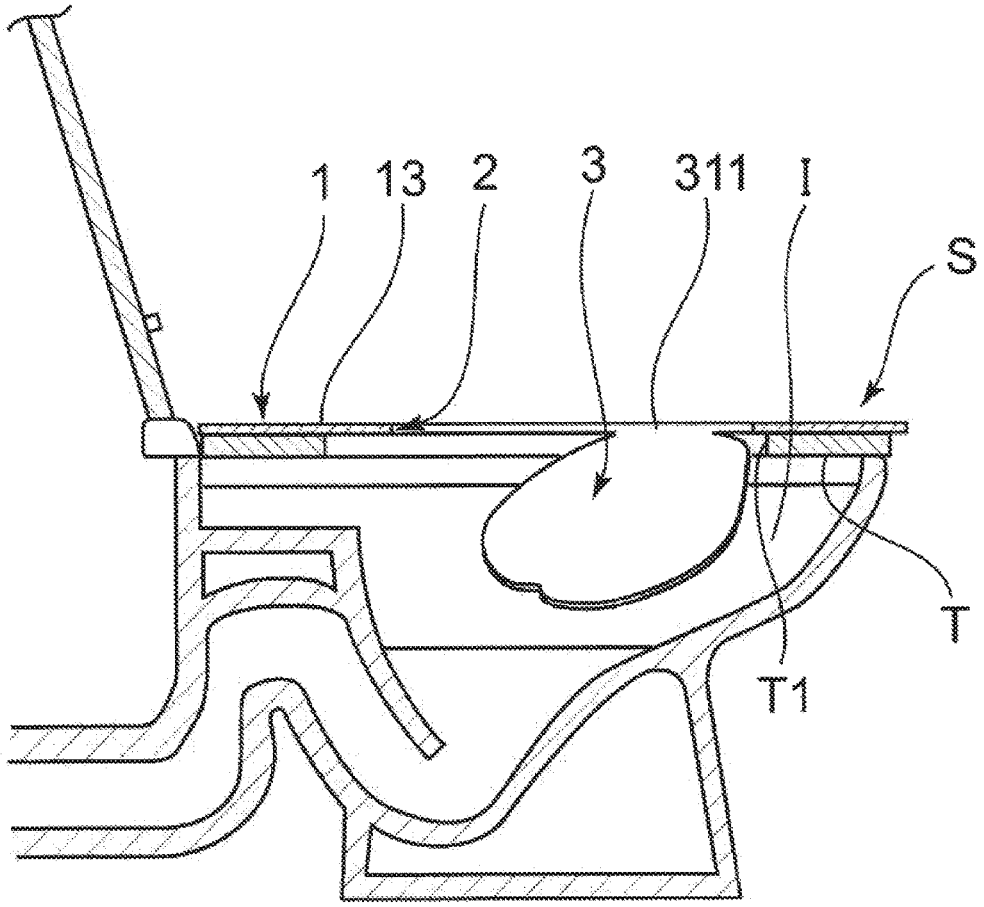
FIG. 8 is a vertical cross-sectional view showing a usage state of the toilet seat sheet of FIG. 1.

Then, as shown in FIGS. 6 to 8, when the breaking connection 323 is cut off from the sheet body 1, the separation portion 3 hangs downward from the hanging connection 311 as a base end, and adheres to the front side inner surface I of the toilet bowl. At this time, since the separation portion 3 is placed right obliquely forward of the opening 2 as shown in FIG. 7, user's discomforts, such as, e.g., the separation portion 3 to which the user's urine is adhered comes into the user's view, or when the user is a man, the separation portion 3 comes into contact with a part of the user's body, etc., can be alleviated.

Next, the user performs defecate through the opening 2 formed by hanging down of the separation portion 3. Then, the user wipes his/her butt with a toilet paper and drops the used toilet paper into the toilet bowl.

Finally, the user stands up to leave the buttocks D off the toilet seat sheet S, and flushes with water. As a result, the separation portion 3 adhering to the inner surface I of the toilet bowl is pulling in by the flushing water, causing pulling of the sheet body 1 by the pulled separation portion 3 via the hanging connection 311, which enables automatic discharging of the toilet seat sheet S from the toilet seat T. This enables the user's comfortable and hygienical use of the toilet seat T.

In FIGS. 4 to 8, the sheet body 1 is depicted in the form of a flat plate, but this is for convenience of explanation. In actual, the periphery of the sheet body 1 bends downward along the outer edge of the toilet seat T.

In the aforementioned embodiment, although the separation portion 3 is formed to have the same size and the same shape as the opening 2 by being cut out from the sheet body 1, it is not necessary to form the same size and the same in shape.

Further, although the separation portion 3 is formed into a heart shape in a plan view, but not required to be formed into a heart shape in a plan view.

Further, although the hanging connection 311 is provided at the right obliquely forward front side edge 31, it may be provided at the left obliquely front side edge 31, or the hanging connection 311 may not be provided.

Further, the hanging connection 311 is provided with perforations along the length direction, but it is not always required to form such perforations.

Although the embodiment of the present invention was described with reference to the drawings, the present invention is not limited to the embodiment shown in the drawings. Various modifications and variations can be made to the illustrated embodiment within the same scope as the present invention or within its equivalent range.

The invention claimed is:

1. A toilet seat sheet comprising:

a sheet body;

an opening formed in a central section of the sheet body; and a separation portion configured to be separated from an inner edge of the opening, wherein the separation portion is provided with a breaking connection that connects the separation portion to the sheet body, the breaking connection being arranged on a right obliquely rear side or a left obliquely rear side of a rear side edge of the inner edge of the opening, and wherein the rear side edge of the separation portion includes a right side outwardly curved section that protrudes right obliquely rearward and a left side outwardly curved section that protrudes left obliquely rearward, the right side outwardly curved section and the left side outwardly curved section being arranged side by side and connected by a left-right connecting portion having a curved shape.

2. The toilet seat sheet as recited in claim 1, wherein the separation portion is formed in a heart shape in a plan view.

3. The toilet seat sheet as recited in claim 1, wherein the breaking connection is positioned within a range of 90 degrees to 180 degrees from a foremost end of the separation portion centering on a gravity center position of the separation portion.

4. The toilet seat sheet as recited in claim 1, wherein the breaking connection has a length within a range of 1 mm to 5 mm.

5. The toilet seat sheet as recited in claim 1, wherein the separation portion is provided with a hanging connection at an inner edge of the opening, and is configured to hang down via the hanging connection when the breaking connection is detached from the inner edge of the opening.

6. The toilet seat sheet as recited in claim 5, wherein the hanging connection is provided at the inner edge on a right obliquely front side or a left obliquely front side of the opening.

7. The toilet seat sheet as recited in claim 1, wherein the right side outwardly curved section and the left side outwardly curved section curve inwardly towards the opening to the left-right connecting portion.

8. The toilet seat sheet as recited in claim 5, wherein the opening includes a foremost end and the hanging connection is positioned rearward of the foremost end.

* * * * *